US005378855A

United States Patent [19]

Delalle

[11] Patent Number: 5,378,855

[45] Date of Patent: Jan. 3, 1995

[54] ELECTRICAL CONNECTOR

[75] Inventor: Jacques Delalle, Triel-sur-Siene, France

[73] Assignee: Raychem SA, France

[21] Appl. No.: 971,927

[22] PCT Filed: Jun. 24, 1991

[86] PCT No.: PCT/GB91/01016

§ 371 Date: Dec. 21, 1992

§ 102(e) Date: Dec. 21, 1992

[87] PCT Pub. No.: WO92/00616

PCT Pub. Date: Jan. 9, 1992

[30] Foreign Application Priority Data

Jun. 25, 1990 [GB] United Kingdom ..... 9014119

[51] Int. Cl.[6] ..... H01R 4/22; H01R 43/00

[52] U.S. Cl. ..... 174/87; 29/872; 174/84 R; 174/DIG. 8

[58] Field of Search ..... 174/87, 84 R, 84 C, 174/DIG. 8; 29/868, 872

[56] References Cited

U.S. PATENT DOCUMENTS

| | | | |
|---|---|---|---|
| 1,297,614 | 3/1919 | Viersen | 174/87 |
| 3,083,260 | 3/1963 | Bird | 174/87 |
| 3,243,211 | 3/1966 | Wetmore | 287/78 |
| 3,525,799 | 8/1970 | Ellis | 174/84 R |
| 3,708,611 | 1/1973 | Dinger | 174/84 C |
| 4,112,251 | 9/1978 | Scott | 174/87 |
| 4,531,016 | 7/1985 | Duve | 174/87 |
| 4,595,724 | 6/1986 | Koblitz | 174/84 R X |
| 4,803,779 | 2/1989 | Blaha | 29/878 |
| 4,907,623 | 3/1990 | Kinney et al. | 138/108 |
| 5,221,815 | 6/1993 | Bostock et al. | 174/84 R |
| 5,260,515 | 11/1993 | Braun, Jr. | 174/87 |

FOREIGN PATENT DOCUMENTS

| | | |
|---|---|---|
| 513245 | 10/1939 | United Kingdom . |
| 1237853 | 6/1971 | United Kingdom . |
| WO87/05447 | 9/1987 | WIPO . |
| WO88/09068 | 11/1988 | WIPO . |

*Primary Examiner*—Morris H. Nimmo

*Attorney, Agent, or Firm*—Sheri M. Novack; Herbert G. Burkard

[57] ABSTRACT

A device (1) for forming an electrical connection at the end of a bundle of wires (2) comprises an electrically insulating, preferably heat-shrinkable, sleeve (3), a metallic connecting element (4) located within the sleeve, and a quantity of solder (8) for forming a permanent electrical connection between the conductors. The connecting element (4) has a tapering internal surface which has a screw thread so that a temporary electrical connection can be formed by screwing the bundle of wires into the connecting element. Preferably the connecting element is formed by winding a wire, e.g. hard tempered copper wire, into a frusto-conical form. Splices in wire bundles may be made by means of a device in which the connecting element has a pair of internally threaded portions into which different cable bundles can be screwed.

16 Claims, 3 Drawing Sheets

ELECTRICAL CONNECTOR

This invention relates to electrical connectors, and especially to connectors for forming solder joints between conductors in such articles as automotive harnesses and the like.

Electrical harnesses, for example as manufactured in the automotive industry, are often quite complex. In some instances they are manufactured by forming two or more sub-assemblies of wires, terminals, connectors and any other components, and then forming electrical connection(s) between the sub-assemblies. In such a case the assembly of the harness my be controlled by computer permitting, with the aid of a monitor, the assembly operator to see schematically the lay up and to check correct build-up of the assembly at each stage of the harness manufacture. In order to enable this control process to operate the ends of the conductors of the sub-assemblies are connected, e.g. by means of spring contacts, and an electrical current or signal is passed through the assembly in order to obtain verification that the harness is correct. It is only after such verification is obtained that the clips are removed and a permanent electrical connection is formed.

According to the invention, there is provided a device for forming an electrical connection at the end of a bundle of elongate electrical conductors, which comprises an electrically insulating sleeve, a metallic connecting element located within the sleeve, and a quantity of solder for forming a permanent electrical connection between the conductors, the connecting element having a tapering internal surface which has a screw thread, so that a temporary electrical connection can be formed by screwing the bundle of conductors into the connecting element.

Preferably the device includes an element for holding the bundle before or while the permanent electrical connection is formed. For example the element may resist withdrawal of the bundle so that the connection will be able to withstand normal handling of the harness during assembly without the connection inadvertently becoming loose or breaking, but can be removed if desired, for example in order to replace one or more sub-assemblies. Such an element may, for example, comprise a ring located inside the sleeve which is provided with one or more teeth or gripping edges for engaging insulation of the conductors forming the bundle. The teeth or gripping members preferably have substantially the same axial inclination as has the screw thread of the connecting element, so that the bundle can be inserted into the sleeve by rotating the bundle within the sleeve and applying a forward pressure, but that removal of the sleeve from the insulated conductors by pulling and/or unscrewing is resisted. Alternatively, the element may be provided in order to hold the bundle during or immediately before recovery of the sleeve. For example, a fusible or infusible (cross-linked) polymeric ring, preferably a heat-shrinkable polymeric ring may be provided in the sleeve. Such a ring may be made to melt or recover before recovery of the sleeve if its melting or recovery point is lower than that of the recoverable sleeve recovery of the ring in this way can be used to reinforce the grip on the bundle and to eliminate or reduce the risk of piercing of the sleeve wall by the conductor strands. Such an element may, for example have a melting or softening point in the range of from 60° to 100° C. Examples of materials from which the polymeric ring may be formed include ionomers, e.g. Surlyn, or from polyamides, e.g. nylon 6, 66, 11 or 12. After the installed device has cooled, the element will assist in maintaining mechanical rigidity of the assembly.

The device according to the invention has the advantage that the conductors can be electrically joined to form a temporary joint which is disconnectable but is able to have a high degree of dependability, in order, for example to test the connected conductors, and can then be permanently joined with no further manipulation of the joint but simply by heating the sleeve in order to melt the solder. In addition, the tapering interior of the connecting element enables bundles formed from a range of conductor sizes to be handled by the device.

In the broadest aspect of the invention the device includes a connecting element having a single tapering internal surface so that a stub splice can be formed between a bundle of conductors inserted into one end of the sleeve, the other end of the sleeve for example being closed. However, it is possible for devices according to the invention to include connecting elements having more than one tapering internal surface so that, for example an in-line splice may be formed between a pair of bundles of conductors. Thus, according to another aspect, the invention provides a device for forming a splice between a pair of bundles of elongate electrical conductors, which comprises an electrically insulating sleeve, a metallic connecting element located within the sleeve and a quantity of solder for forming a permanent electrical connection between the conductors of the bundles, the connecting element having two end portions each of which has a tapering internal surface and at least one of which has a screw thread so that a temporary electrical connection can be formed by inserting one of the bundles of conductors into each end portion of the connecting element.

Where the end portions of the connecting element are rotatable with respect to each other it is often desirable to form the sleeve in two parts, each part being located on one of the end portions of the connecting element so that the connecting element end portions can be rotated by twisting the part of the sleeve it is located in.

Usually the sleeve will be dimensionally recoverable, and especially dimensionally heat-recoverable, that is to say the article has a dimensional configuration that may be made substantially to change when subjected to heat treatment.

Usually these articles recover, on heating, towards an original shape from which they hake previously been deformed but the term "heat-recoverable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. Nos. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate state.

In the production of heat-recoverable articles, the polymeric material may be cross-linked at any stage in the production of the article that will enhance the desired dimensional recoverability. One manner of producing a heat-recoverable article comprises shaping the polymerics material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Any material to which the property of dimensional recoverability may be imparted may be used to form the sleeve. Preferred materials include low, medium or high density polyethylene, ethylene copolymers, e.g. with alpha olefins such as 1-butene or 1-hexene, or vinyl acetate, polyamides or fluorpolymers, e.g. Polytetrafluoroethylene, vinylidine fluoride or ethylene-tetrafluoroethylene copolymer.

The fact that the ends of the conductors are enclosed in the connection element will also reduce the risk of any strands of the conductors piercing the sleeve during recovery thereof. Also, the conducting element can act as a heat-sink thereby preventing overheating of the device during recovery.

At least in the broadest aspect of the invention the connecting element my generally have any form although it is preferred for it to be formed by coiling a piece of wire into a tapering coil so that the windings form the screw thread. Preferably the internal surface of the connecting element is at least partly conical, for example it may be conical or frusto-conical. If the connecting element is formed from a wire, it can grip the bundle of conductors introduced therein due to the resilience of the wire and the fact that it will be enlarged radially to some extent by the introduction of the bundle. However, in one advantageous form of device it has been radially expanded from its relaxed state during manufacture of the device and to be retained in its expanded state so that it will radially contract, or attempt radially to contract, when the permanent connection is formed. Thus, for example, the spring may be held out against its resilient recovery forces by the sleeve or by the solder, so that softening of the sleeve or melting of the solder will allow the spring to recover. For example, a boss may be formed on the internal surface of the sleeve or on the internal surface of the solder which will disappear when the device is heated. The degree of expansion need not be great, for example it may be not more than 5% or even not more than 2%, since it may be desirable that the coil remains in contact with the solder element when the device is heated.

The wire may be formed with a circular cross-section, although it is preferred for the wire to have a relatively sharp ridge along its length, e.g. formed by cold drawing or cold rolling, which, when the wire has been coiled, is directed toward the interior of the coil in order to form the screw thread. In particular it is advantageous for the wire to be formed with a polygonal, and especially a square, cross-section. The wire may be formed from any appropriate metal or metal alloy, but preferably is formed from copper, and especially from copper having substantially the same purity as that conventionally employed for electrical conductors.

Other configurations of connecting element may, however, be employed. For example it may be formed from a solid block of metal that has been tapped with a screw thread. In the case of the connecting element used for the splice, it may be convenient, although it is not essential, for both end portions to be formed in the same way. For example, the entire connecting element may be formed from a single piece of wire which has been wrapped so as to form a tapering internal profile at each end, it may be formed from a wire and a solid block that has been tapped with a screw thread, or it may be formed from two solid blocks of metal. Alternatively, connecting elements in which one end does not have a screw thread could be employed, in which the bundle of wires is simply pushed into the connecting element. Where the connecting element is provided with a screw thread at each end, the screw threads may both have the same handedness, or one may be right-handed while the other is left-handed. Since it is not normally necessary to twist the sleeve about the conductors by more than one quarter to one half a revolution in order to form a temporary connection the choice of thread sense does not cause any particular problem. It is, however, possible for the end portions of the connecting element to be rotatable with respect to each other. For example, end portions formed from a wire may both be supported on a small cylindrical connecting element by wrapping part of the wire into a circumferential groove in the connecting element.

As mentioned above, the device includes a quantity of solder, i.e. a quantity of soft solder as distinct from brazing material, for forming a permanent solder connection. The solder may, for example, simply be in the form of an $Sn_{63}Pb_{37}$ eutectic composition which will melt as the device is heated and the sleeve recovers, or more than one solder composition having differing melting points may be employed, as described in International Application No. WO88/09068. In this form of device, melting of the higher melting point component, e.g. $Sn_{96.5}Ag_{3.5}$ eutectic will provide a visual indication that the device has been heated sufficiently to melt the lower melting point composition and to form a satisfactory solder joint. If desired the lower melting point solder may be a non-eutectic composition and, for example as described in International Application No. PCT/GB90/00234, the higher and lower melting point solder compositions may together form a eutectic composition. For example, a non-eutectic $Sn_{60}Pb_{40}$ lower melting point component may be employed with a higher melting point component formed from pure tin in relative amounts that an $Sn_{63}Pb_{37}$ eutectic is formed. The disclosures of these two patent applications are incorporated herein by reference. An advantage of employing a two component solder, and especially a tin, $Sn_{60}Pb_{40}$ combination is that it reduces the possibility of "wicking" that is to say, travel of the solder along the conductors and away from the joint area due to capillary action by the stranded conductors, which can be caused by prolonged heating of the device.

The solder may be positioned anywhere where it will be able to flow into the connecting element to form a solder joint. The solder may be employed in the form of a ring or in any other form for example a ball, and may be disposed symetrically about the sleeve axis or offset from it. The solder element may, for instance, be located at the smaller diameter end of the connecting element in which case it may be in the form of a ball or plug, or it may be located in the region of a large diameter end of the connecting element, for example in the form of a ring. Preferably the solder is in the from of an element that surrounds the connecting element, especially where the connecting element is in the form of a coil so that the fused solder can flow through the windings of the coil to the interior thereof. More than one quantity of solder may be employed, for example where the connecting element has more than one tapering internal surface for forming a splice.

According to another aspect, the invention provides a method of forming an electrical harness from a plurality of insulated electrical wires, which includes:

(a) gathering a number of the insulated wires together to form a bundle at least at the end of the wires;
(b) inserting the bundle into a device as described above by means of a screwing action in order to form a temporary electrical connection;
(c) applying electrical signals to the harness so formed in order to ascertain information about it; and
(d) heating the sleeve to form a permanent solder connection between the wires.

The device may be heated by means of a hot air gun or infrared lamp as commonly used to recover solder connector devices, or the device may be heated by induction heating methods.

Two forms of device according to the invention will now be described by way of example with reference to the accompanying drawings in which.

Figure 2:
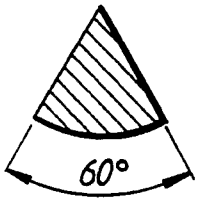
FIG. 2 is a cross-section of the wire employed to form the coil of the device.
Figure 3:
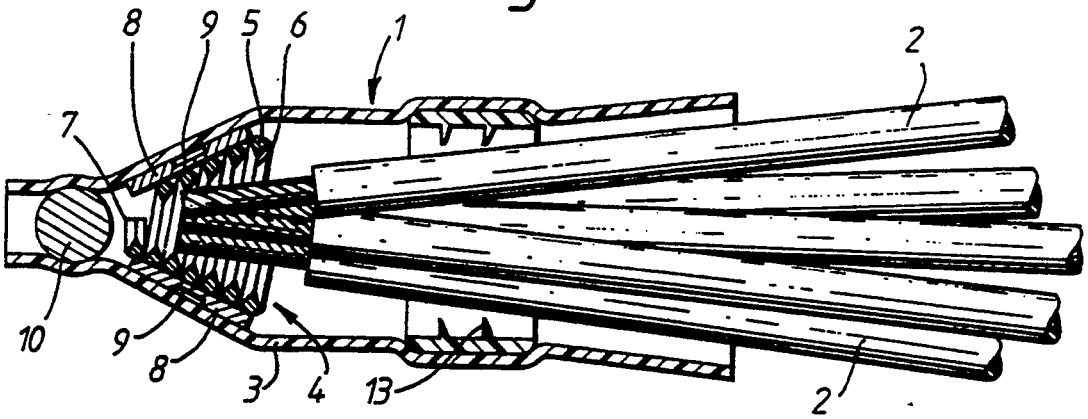
FIG. 3 is a sectional elevation of the device shown in FIG. 1 with a bundle of wires inserted therein.

Referring to the accompanying drawings a device 1 for forming a connection between a number of electrically insulated wires 2 comprises a dimensionally heat-recoverable sleeve 3 formed from crosslinked and expanded polyvinylidine fluoride, and a connecting element 4 formed as a frusto-conical spring or coil of hard temper wire. The copper wire 5 has a cross-section as shown in FIG. 2 which, as can be seen is generally circular over part of its circumference but which has two flattened surfaces formed by cold rolling or cold drawing which meet the form a relatively sharp ridge 6. This ridge 6 is oriented so that it is directed toward the interior of the frusto-conical coil 4 and forms a screw thread. One end 7 of the wire is located at the smaller diameter of the connecting element 4 is bent so that it extends across the axis of the coil and prevents over insertion of the conductor bundle. In some instances it may be advantageous to expand the diameter of the coil 4 by opening out the ends of the copper wire 5 and retaining them in their new position, for example by means of a lip on the solder ring.

A strip 8 of composite solder composition which has been formed into a ring and swaged into a frusto-conical shape sits in contact with the outer surface of the coil 4. The composite solder strip is formed from a major quantity of $Sn_{60}Pb_{40}$ non-eutectic composition and has a small temperature control ring 9 of pure tin on its outwardly directed surface.

The device is closed at one end by means of a spherical plug 10 of sealing material, e.g. irradiated or non-irradiated polyethylene, for example as described in British Patent Application No. 9002093.4.

The sleeve 3 also contains a moulded ring 11 formed from crosslinked nylon which is positioned between the connecting element 4 and the open end 12 of the sleeve. The internal surface of the ring 11 has a number of elongate teeth 13 which are oriented at the same angle to the axis of the device as the wire 5 in the coil 4.

Figure 4:
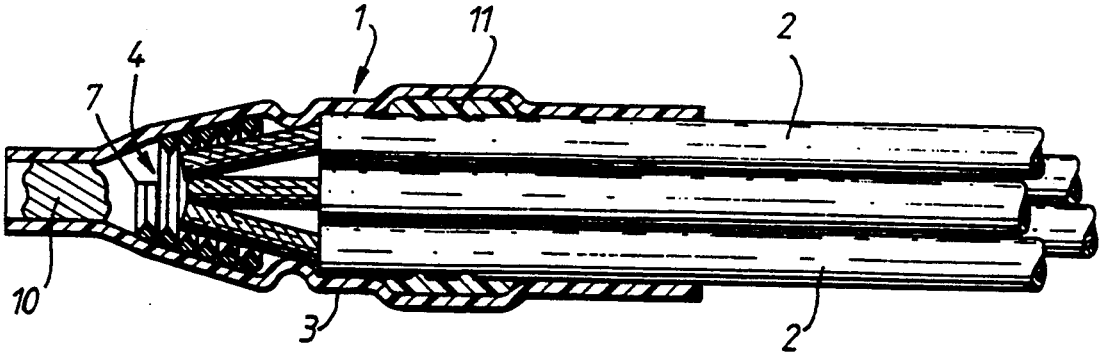
FIG. 4 is a sectional elevation of the completed joint.

In operation, during the manufacture of a harness, a number of insulated wires 2 having their insulation stripped from the ends of the wires, are bundled together and are inserted into the device 1. Complete insertion is achieved by rotating the bundle (in fact, rotating the device about the bundle) so that the end of the conductors are screwed into the connecting element 4 and the teeth 13 on the ring 11 grip the insulation of the wires and resist them being pulled out of the sleeve 3. At this stage a dependable low resistance joint has been formed, and the harness may be tested by passing electrical signals along the wires 2 and analysing the results by means of an appropriate microcomputer. Once this has been performed, a permanent connection may be formed between the wires 2 simply by heating the sleeve 3, for example by means of an infrared lamp, a hot-air gun or a small oven, so that it recovers about the bundle of wires 2. During recovery the solder 8 melts and flows through the windings of the coil 4 thereby forming a strong solder joint between the conductors of the wires 2 and the connecting element 4. At the same time the nylon ring softens and the teeth 13 collapse, thereby allowing the ring 11 to be forced into conformity with the bundle under the recovery forces of the sleeve 2. Heating is continued until the temperature control ring 9 of the solder strip has melted, thereby allowing the overlying part of the sleeve 3 to recover fully. The completed joint is shown in FIG. 4 without the solder, for the sake of clarity.

Figure 5:
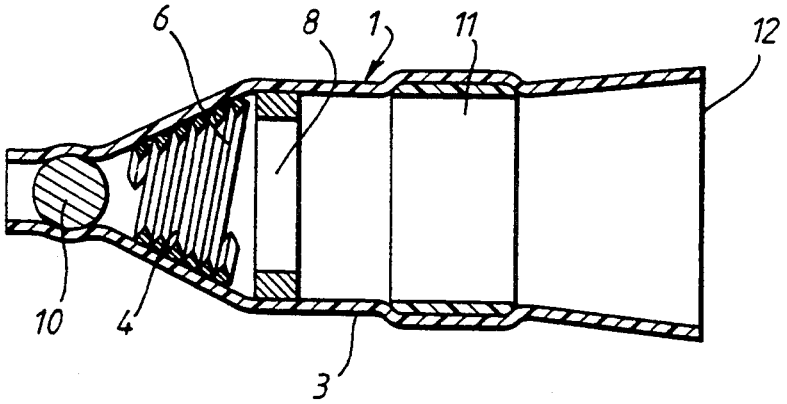
FIG. 5 is a sectional elevation along the axis of a second form of device.

A second form of device 1 is shown in FIG. 5. This form of device is generally similar to the device shown in FIG. 1 but with two exceptions. First, the moulded polyamide ring 11 of FIG. 1 has been replaced with a low recovery temperature polyamide ring that has been formed by extruding a tube and chopping it into short lengths. Secondly, the solder ring 8 of FIG. 1 has been replaced with a solder ring 8 which is located adjacent to the larger diameter end of the coil 4. If desired the internal surface of the ring 11 may be coated with a layer of adhesive, preferably a hot-melt adhesive (not shown) in order to provide a seal against moisture ingress to the device. In addition or alternatively, one or more thermoplastic sealing rings may be provided in the region of the end 12 of the sleeve 3.

Figure 1:
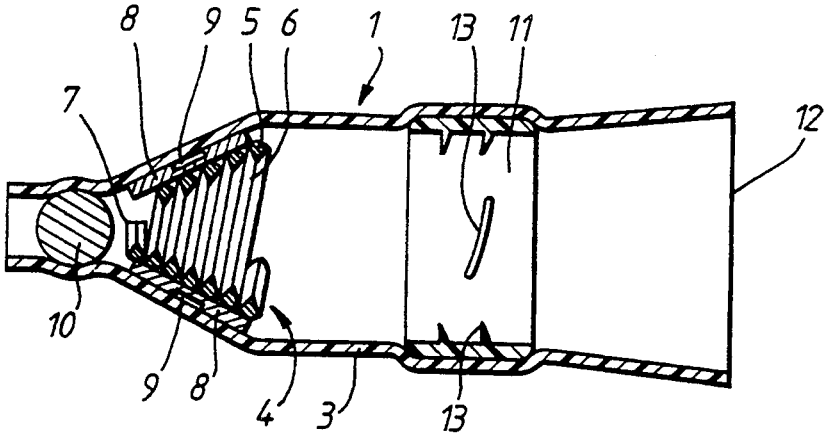
FIG. 1 is a sectional elevation along the axis of a device according to the present invention.

The wire bundle is inserted into the device as described with respect to FIG. 1. When the device is heated in order to recover the sleeve 3, the ring 11 will usually recovery slightly before the sleeve 3 and thereby help to maintain the wires in position.

Figure 6:
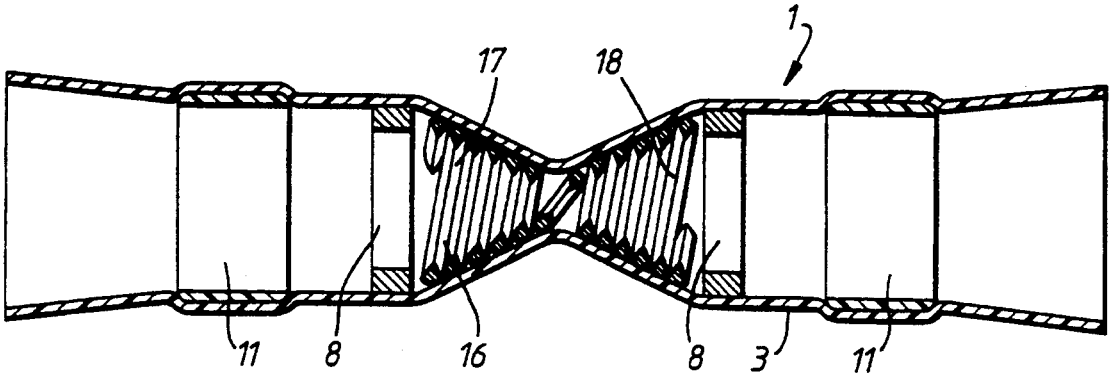
FIGS. 6 and 7 are sectional elevations along the axis of connectors suitable for forming a splice.

FIG. 6 shows a device having two open ends which is suitable for forming a splice between a pair of bundles of conductors. The device comprises a dimensionally recoverable sleeve 3 formed from crosslinked and expanded polyvinylidine fluoride, and a connecting element 16 formed from hard temper copper wire. The connecting element 16 is formed having two opposite halves 17 and 18 each of which has a tapering internal surface for receiving a separate conductor bundle. As shown, the connecting element 16 has been formed by wrapping a single piece of wire in the same sense along its entire length so that the internal surface of both halves 17 and 18 both have a right-handed thread. Although the wire forming the connecting element is shown as a circular wire that has been rolled to form two fiat surfaces and an edge between them, it may be preferred to employ wire having a square cross-section.

The device is substantially symmetrical about the centre of the connecting element 16, each half of the device having the same general configuration as that of the device shown in FIG. 5, in which a solder ring 8 located adjacent to each end of the connecting element 16. The device has a pair of rings 11 which are constructed, and function, exactly as those shown in FIG. 5.

In operation, in order to form a splice, a bundle of conductors is introduced into one open end of the device and into one end of the connecting element 16, and the device is then twisted about the bundle to secure it. The second bundle is then inserted into the other open end of the device and connecting element. After securing the bundle in the connecting element 16 by twisting, the electrical performance of the harness bundle can be tested and the device then be heated to recover the sleeve 3 and form a permanent solder connection.

Figure 7:
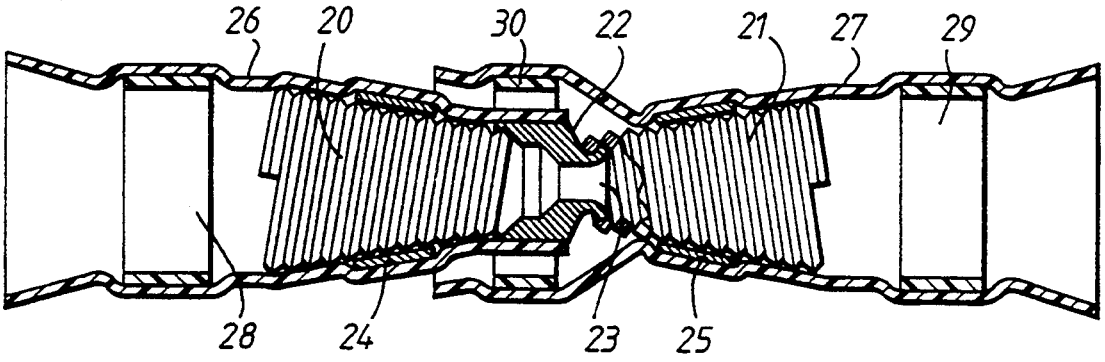

FIG. 7 shows a further form of device that is suitable for forming an in-line splice between a pair of bundles of conductors. A connecting element comprises a pair of generally frusto conical coiled parts 20 and 21 which are formed from hard tempered copper wire. The wire has a square cross-section and the edges of the wire form an internal thread in each coiled part, one coiled part 21 having a right handed thread and the other coiled part 20 having a left handed thread. One of the coiled parts 20 is screwed into the end of a hub element 22 that has an internal thread, and the other coiled part 21 is mounted over a boss 23 of the hub element so that it is freely rotatable.

A ring of solder 24,25 is located about the external surface of each coiled part 20 and 21, and a heat-shrinkable polyvinylidine fluoride sleeve 26 and 27 is partially recovered about the coiled parts, solder and a pair of fusible inserts 28 and 29. The lengths and position of the sleeves 26 and 27 is such that they axially overlap for an extent, and a fusible ring 30 formed for example from polyethylene is located within the end region of sleeve 27 within the region of overlap.

In operation, after a bundle of conductors has been introduced into sleeve 26 and secured in the coiled part 20 of the connecting element, a second bundle can be inserted into the sleeve 27 and secured within the coiled part 21 by twisting the sleeve and coiled part about the conductors. This twisting action does not affect the sleeve 26 and the coiled part 20 and so there is no liklihood of them being unscrewed from the bundle.

The splice may then be tested electrically as described above and a permanent joint be formed.

Figure 8:
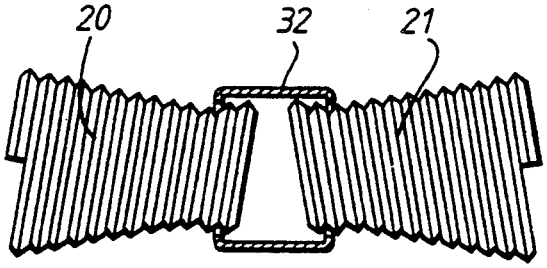
FIGS. 8 and 9 are elevations of two further forms of connections element that can be employed in the device of FIG. 7.
Figure 9:
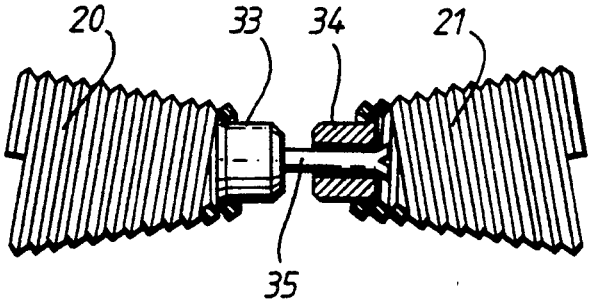

FIGS. 8 and 9 show two alternative forms of connecting element that may be employed in the device shown in FIG. 7. In the element shown in FIG. 8 the ends of the coiled parts 20 and 21 are splayed outwardly to form a waist, and a ting 32 having inwardly bent lateral edges is positioned over the ends of the coiled parts to retain them together while allowing them to rotate. In FIG. 9 both coiled parts 20 and 21 are fitted over a pair of mating collars 33 and 34, one which has a shaft 35 that extends through a hole 36 in the other end is retained therein in such a way that it can rotate.

I claim:

1. A device for forming an electrical connection at the end of a bundle of elongate electrical conductors, which comprises an electrically insulating sleeve, a metallic connecting element located within the sleeve, and a quantity of solder located within the sleeve and arranged to form a permanent electrical connection between the conductors, the connecting element having a tapering internal surface which has a screw thread, so that a temporary electrical connection can be formed by screwing the bundle of conductors into the connecting element.

2. A device as claimed in claim 1, wherein the sleeve is dimensionally heat-recoverable.

3. A device as claimed in claim 1, which includes a holding element for resisting withdrawal of the bundle from the sleeve before or while the permanent electrical connection is formed.

4. A device as claimed in claim 3, wherein the holding element comprises a ring that is provided with one or more teeth or gripping edges for engaging insulation on the conductors.

5. A device as claimed in claim 4, wherein the or each tooth or gripping edge has an axial inclination that is substantially the same as the axial inclination of the screw thread.

6. A device as claimed in claim 1, wherein the connecting element is formed from a tapering coil of wire.

7. A device as claimed in claim 6, wherein the coil is retained in a radially expanded state so that it will radially contract, or attempt radially to contract when the permanent connection is formed.

8. A device as claimed in claim 6, wherein the wire has a relatively sharp ridge along its length which is directed toward the interior of the coil in order to form the screw thread.

9. A device as claimed in claim 1, wherein the connecting element is formed from copper.

10. A device as claimed in claim 1, wherein the solder is formed from a plurality of compositions that have differing melting points.

11. A device as claimed in claim 1, wherein the solder is in the form of a ring located around the connecting element.

12. A device as claimed in claim 11, wherein the solder element is frusto-conical in shape and sits in contact with the connecting element.

13. A device as claimed in claim 2, wherein the solder is in the form of a ring located around the connecting element.

14. A device as claimed in claim 13, wherein the solder element is frustoconical in shape and sits in contact with the connecting element.

15. A device for forming a splice between a pair of bundles of elongate electrical conductors, which comprises an electrically insulating sleeve, a metallic connecting element located within the sleeve and a quantity of solder located within the sleeve and arranged to form a permanent electrical connection between the conductors of the bundles, the connecting element having two end portions each of which has a tapering internal surface and at least one of which has a screw thread so that a temporary electrical connection can be formed by inserting one of the bundles of conductors into each end portion of the connecting element.

16. A method of forming an electrical harness from a plurality of insulated electrical wires, which includes:

(a) gathering a number of insulated wires together to form a bundle at least at the end of the wires;

(b) providing a device which comprises an electrically insulating sleeve, a metallic connecting element located within the sleeve, and a quantity of solder located within the sleeve and arranged to form a permanent electrical connection between the conductors, the connecting element having a tapering internal surface which has a screw thread;

(c) inserting the bundle into the device by means of a screwing action in order to form a temporary electrical connection;

(d) applying electrical signals to the harness so formed in order to ascertain information about it; and (e) heating the sleeve to form a permanent solder connection between the wires.

* * * * *